US006913422B2

(12) United States Patent
Rogers

(10) Patent No.: US 6,913,422 B2
(45) Date of Patent: Jul. 5, 2005

(54) SHORING LEG WITH NODE CONNECTORS

(75) Inventor: Peter Rogers, Barrie (CA)

(73) Assignee: Aluma Enterprises Inc., Concord (CA)

( * ) Notice: Subject to any disclaimer, the term of this patent is extended or adjusted under 35 U.S.C. 154(b) by 0 days.

(21) Appl. No.: 10/841,503

(22) Filed: May 10, 2004

(65) Prior Publication Data

US 2005/0025581 A1 Feb. 3, 2005

(51) Int. Cl.[7] ..... E04G 11/00

(52) U.S. Cl. ..... 405/272; 249/18; 249/210; 248/219.4

(58) Field of Search ..... 405/272, 273, 405/288; 249/210, 18, 28; 248/219.3, 219.4, 218.4; 52/283, 289

(56) References Cited

U.S. PATENT DOCUMENTS 4,841,708 A * 6/1989 Johnston ..... 249/18
5,240,089 A * 8/1993 Spera ..... 52/638
6,059,258 A * 5/2000 Jackson ..... 249/18

FOREIGN PATENT DOCUMENTS

GB 2136908 * 9/1984

* cited by examiner

*Primary Examiner*—Frederick L. Lagman

(57) ABSTRACT

A shoring post suitable for use with ledger frames uses node sleeves which surround the shoring post. Preferably, the node sleeves are an extruded component with a center cavity that closely conforms to the exterior of the shoring post. The node sleeves are secured in a manner to maintain the center of the shoring post unobstructed. In a preferred form, the node sleeves are mechanically fastened to the shoring post.

9 Claims, 16 Drawing Sheets

SHORING LEG WITH NODE CONNECTORS

FIELD OF THE INVENTION

The present invention relates to lightweight aluminum alloy shoring posts and in particular, to shoring posts for use with ledger frames.

BACKGROUND OF THE INVENTION

Scaffold and shoring systems can basically be broken into systems where individual upright members are connectable by means of appropriate bracing members which are easily attached to connectors secured on the upright members or to a system where a pair of upright members are connected to form a frame and frames are connected one to the other by means of releasable bracing.

More recently, some shoring systems have used ledger frames in the form of rectangular frames which can be releasably connected between two adjacent uprights. The uprights have a suitable quick connect arrangement for connecting with the ledger frames. These upright members typically have permanent node members which are part of the exterior of the upright members.

For construction projects, it is often necessary to use shoring frames to provide support for a concrete floor or wall which is being poured above the shoring system. During the initial pouring of the concrete, and for a short time thereafter, the shoring system will have high loads and the need for bracing members or ledger frames between the uprights is required. Once the concrete starts to cure, less support is required and basically the ledger frames or bracing between the uprights can be removed. These ledger frames can be used for uprights associated with pouring of the next floor of the building or may be removed, merely to provide better access to the floor for plumbing, electrical and other workers. As can be appreciated, material can be located on these floors and a substantial amount of work can be completed once the ledger frames are removed. The posts render in place awaiting a further curing of the concrete. For this reason, it is often desirable to use a ledger based system to provide better access. In a shoring system which uses shoring frames, it is possible to remove the bracing between frames, however, the actual horizontal members between the uprights of the frame, remain in place. This reduces the access and may result in some interference in locating of equipment. In addition, shoring frame systems are marginally more difficult to remove.

The present invention provides a simple arrangement for providing a shoring post with a series of nodes for connecting with ledger frames.

SUMMARY OF THE INVENTION

A shoring post according to the present invention is for use in association with ledger frames. The shoring post comprises an extruded tubular body of a generally rectangular cross section defined by four sidewalls. Each sidewall includes an outwardly stepped center section running the length of the shoring post with a corresponding recessed channel behind the outwardly stepped center section and interior to the tubular body of the shoring post. This outwardly stepped section is for receiving of mechanical fasteners while keeping the center part of the tubular body essentially clear. The shoring post includes two connecting node sleeves with each connecting node sleeve secured to the shoring post at intermediate positions spaced a short distance from the opposite ends of the shoring post. It is preferred that each node be spaced at a different distance from the end of the shoring post. Each node sleeve includes four nodes aligned with the four sidewalls and spaced outwardly from the sidewalls. Each node is defined by an outer ledger frame support face parallel to the shoring post and an elongate connecting slot located behind the ledger frames support face. Each elongate connecting slot extends through the node sleeve to be opened at the top and bottom surface of the node sleeve.

In an aspect of the invention, each node sleeve is of an aluminum alloy.

In a further aspect of the invention, each node sleeve is of an aluminum alloy and is of a constant cross section and made by extrusion.

In a further aspect of the invention, each node sleeve is secured to the shoring post using a mechanical fastening arrangement.

In yet a further aspect of the invention, each node sleeve is secured to the shoring post by a weld connection.

In yet a further aspect of the invention, each elongate connecting slot is opened to a sidewall of the shoring post.

In yet a further aspect of the invention, each elongate connecting slot is opened to a sidewall of the shoring post and includes a stepped wall profile at said opening and at a rear surface partially defining the elongate connecting slot.

In yet a further aspect of the invention, two cooperating mechanical plate fasteners are used with one mechanical plate fastener securing one node sleeve and the second mechanical fastener securing the other node sleeve. The cooperating plate fasteners are located on opposite sides of the shoring post and each mechanical plate fastener includes support shoulders in contact with the load transfer surfaces of the respective node sleeve to maintain the position of the node sleeve on the shoring post. Each plate fastener includes a mechanical securement thereof to the shoring post beyond the node sleeve.

In yet a further aspect of the invention, the shoring post has a series of holes spaced in the length of the shoring post on each of the two sidewalls thereof which are in opposed relationship. The cooperating plate fasteners use the series of holes for connection with the shoring posts.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
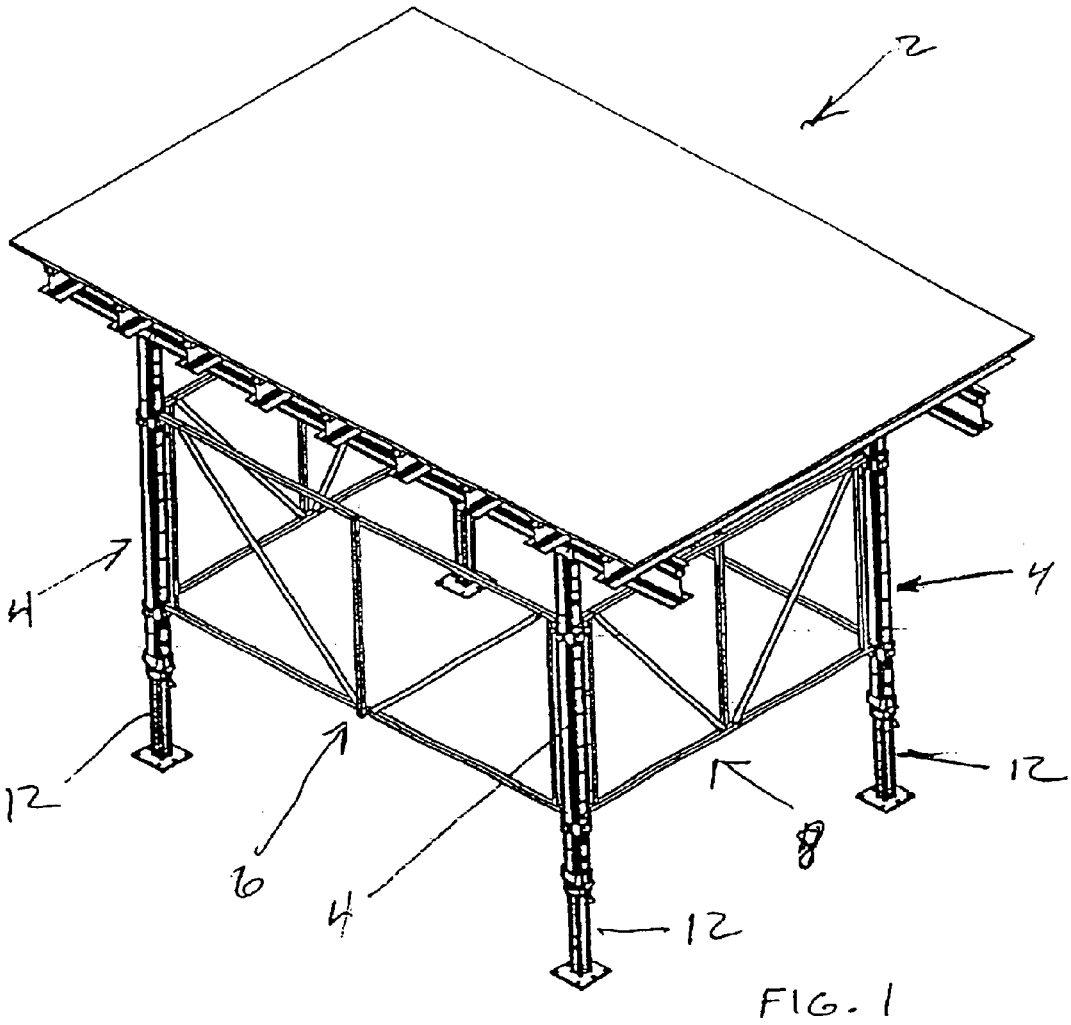
FIG. 1 is a partial perspective view of the shoring system.
Figure 2:
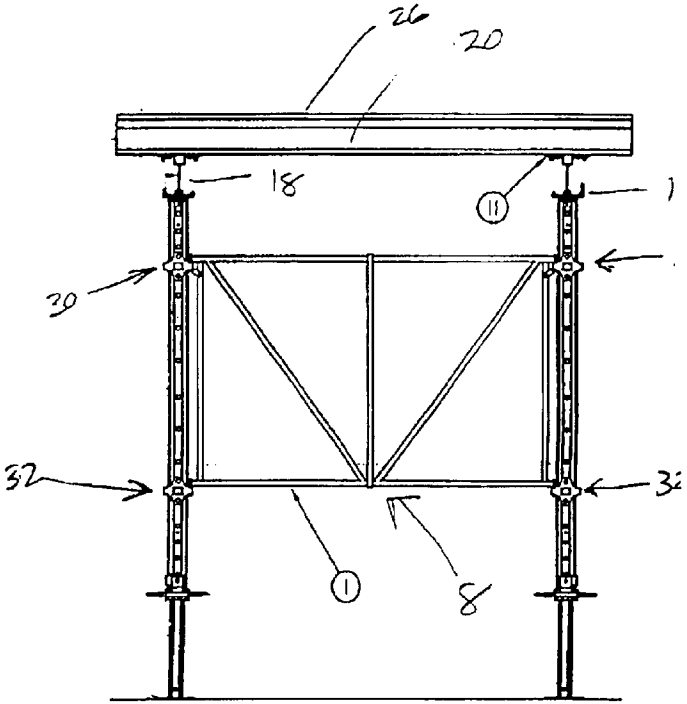
FIG. 2 is a vertical elevation of an end view of the shoring system.
Figure 3:
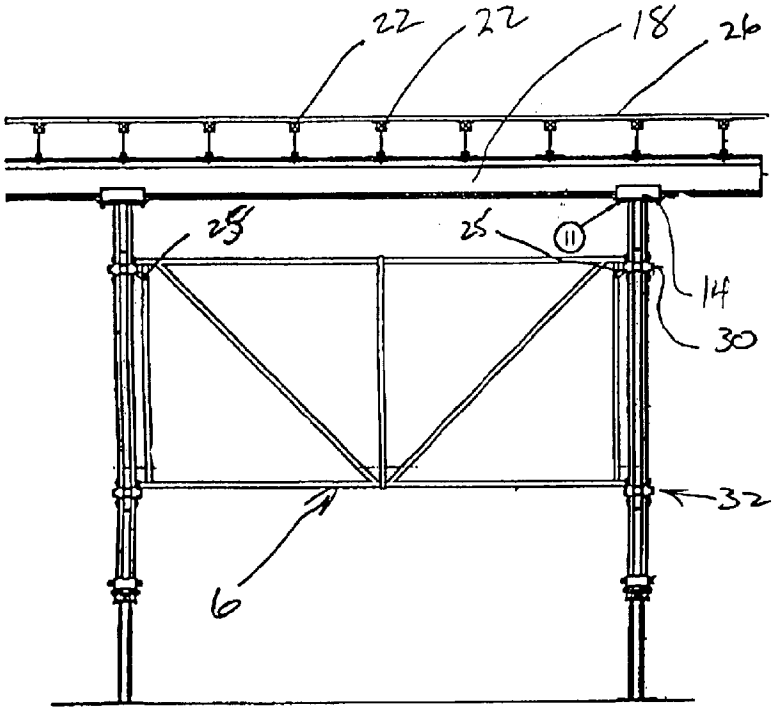
FIG. 3 is a vertical elevation of the side of the shoring system.
Figure 4:
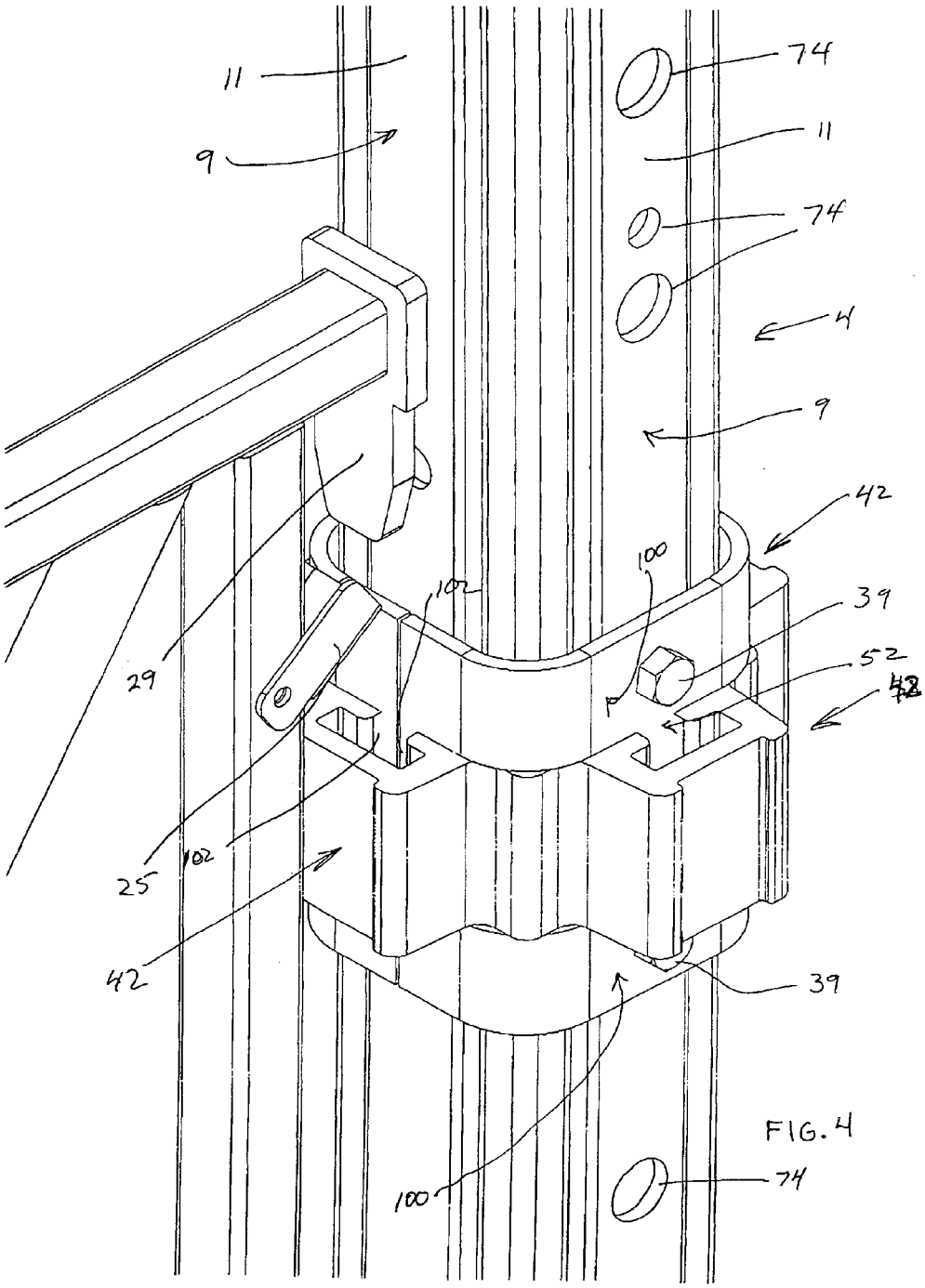
FIG. 4 is a partial perspective view showing a node sleeve on a shoring post with a ledger frame about to be connected to the node sleeve.

The shoring system 2 shown in FIG. 1 has four shoring posts 4 connected on the sides thereof by long ledger frames 6 and connected at the ends by shorter ledger frames 8. Each of the shoring posts 4 include telescopic screw jacks 12 at the base of the posts and a "J" head 14 for supporting the stringer 18 and the support beams 20 shown in FIG. 2. With this shoring system, each of the shoring posts may be adjusted to bring the plywood surface 26 or support surface to the desired height. Once so positioned, the concrete floor can be poured. There would be a series of these shoring posts and ledger frames used for pouring the concrete floor and the shoring posts are easily connected one to the other by means of these drop in ledger frames. Each shoring post can engage up to four ledger frames. Each of the ledger frames at the ends thereof include two downwardly extending tongues 29 as shown in FIGS. 1 and 4 for drop insertion into one of the elongate securing slots 46 of any of the upper node sleeves 30 or the lower node sleeves 32. The plywood support surface 26 is secured relative to the shoring system by be means of nailer strips 22 which are captured in the support beams 20 and nails are used to secure the plywood to the nailer strips. Such nailer strip systems are well known.

Figure 5:
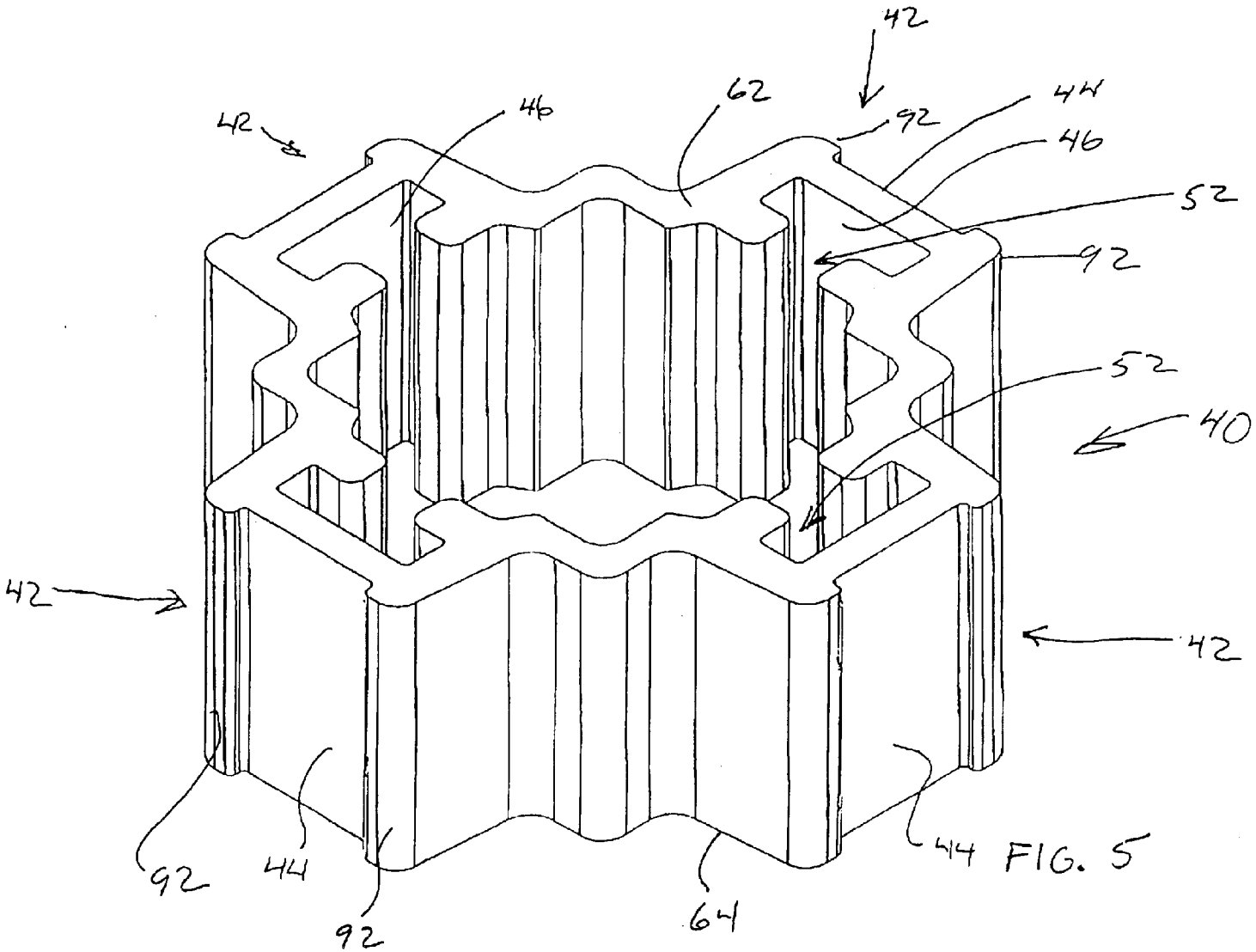
FIG. 5 is a perspective view of the node sleeve.

Each node sleeve 30 or 32 includes four nodes 42 as described in FIG. 5.

In the present arrangement, the upper node sleeves 30 and the lower sleeves 32 are slidable on the outer surfaces of the shoring posts 40. Each shoring post is of a generally rectangular cross section with four sidewalls 9. Each of the sidewalls include an outwardly stepped section 11 as shown in FIG. 4 which defines a shallow recess to the interior of the tubular shoring posts and this recess is adapted to receive a plate fastener for securing of the "U" shaped connectors 100 via the bolts 39 to the shoring post. With this arrangement, the center of the shoring post remains essentially clear of obstruction. This is desired to allow portions of the screw jacks or other equipment to slide or telescope within the center of the shoring post.

As shown in FIGS. 1, 2, 3 and 4, the ledger frames are essentially connected to the shoring posts by means of the nodes and they are dropped into place. Each tongue connector for engaging an upper node sleeve 30 has a gravity lock member 25 at the base of the tongue connector 29 for maintaining the ledger frame in position. This gravity lock member merely pivots on the ledger frame and cams inwardly to clear the node sleeve during downward insertion of the ledger frame and once the ledger frame has been located, the latch moves by gravity or spring bias, inwardly as it has cleared the bottom edge of the upper node. Therefore, to release the frame, the worker merely moves this lock member inwardly and can then remove that portion of the ledger frame. The lower portions of the ledger frame do not include this type of lock, as it would be difficult for the worker to move each lock member to the clear position when the ledger frame is being removed. Once the concrete floor has been poured and/or partially cured, it is often possible to remove the ledger frames and as such, merely the shoring posts are left in place. This allows for convenient access to the space even though the shoring posts remain in place. Even if the concrete floor, which has been poured above the shoring frame, has cured, the shoring posts will often remain in place as upper floors are being poured and the load is being transferred down through the structure.

FIG. 4 shows a shoring post 4 with the node sleeve 38 which has been secured to the exterior of the shoring post and is held in place by four mechanical fasteners 39 with only two of these being shown. It can also be seen how the gravity latche 25 is positioned to cam past the node and retain the ledger frame in position by the latch 25 locking below the node.

As shown in FIG. 4, only two sides of the shoring post receive the bolt connectors 39 used to secure the "U" connectors 100. The free ends of the "U" connector each include an extending tab 102 received in the center opening 52 of a node 42. In this way, the "U" connectors 100 cooperate with each other and the node sleeve to strengthen the mechanical connection. This arrangement is preferred as shoring posts often have two series of holes 74 on two opposed sides of the shoring posts while leaving the other sides of the shoring posts essentially clear of holes. In this way, two shoring posts could be used for forming a shoring frame by mechanically fastening the two shoring posts with fixed bracing members using the holes 74 or could be used in combination with the sleeve node 42 for defining shoring posts which can be used with ledger frames. Conversion from one system to the other system is possible as the node sleeves and the fixed bracing members can be mechanically secured.

Figure 6:
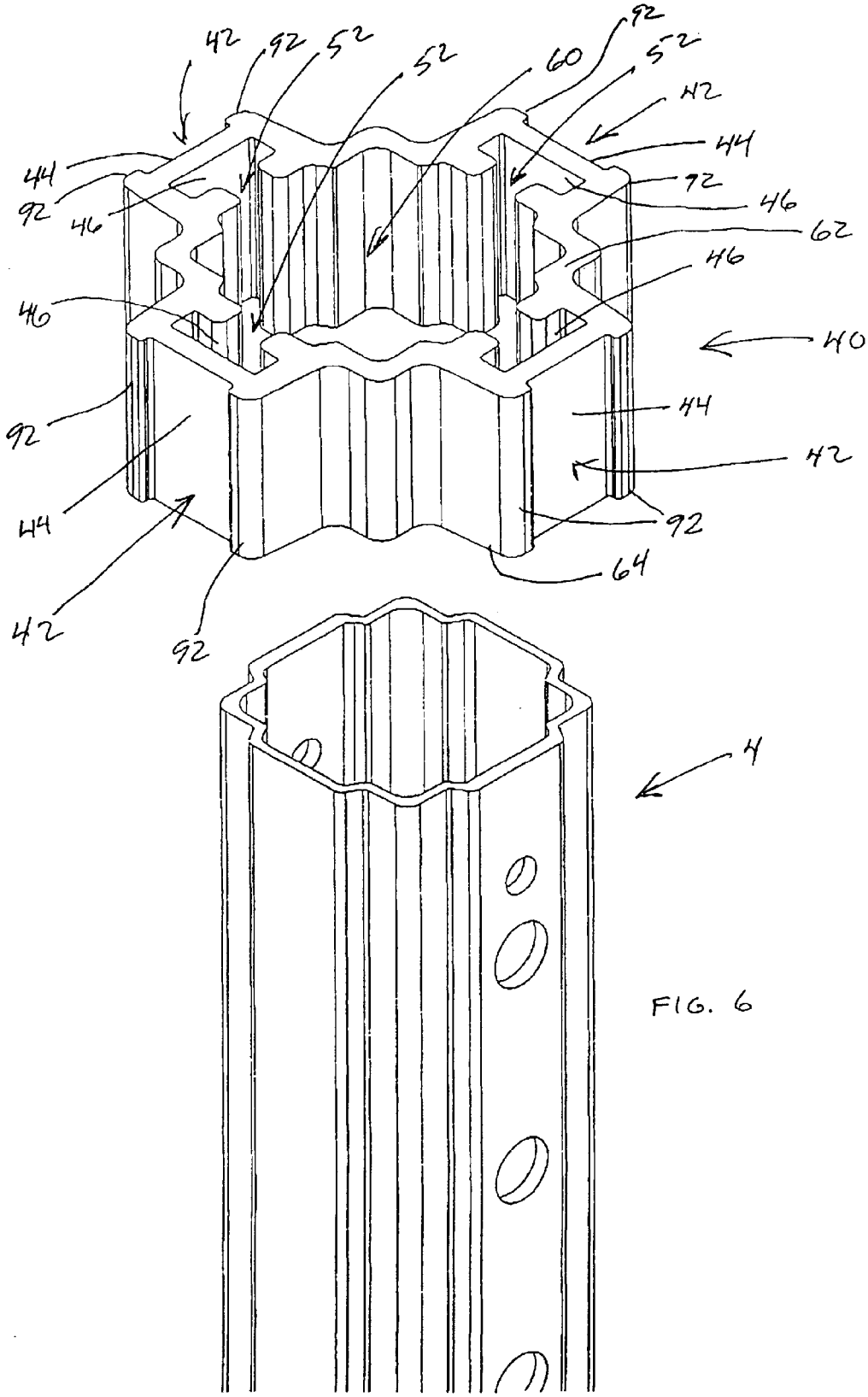
FIG. 6 is a partial perspective view of a node sleeve about to be placed on a shoring post.

The node sleeve 40 as shown in FIG. 6 is preferably made by extrusion with the extrusion merely cut into short lengths. The node sleeve 40 has one large generally rectangular central cavity 60, however, each of the individual nodes 42 have an opening 52 running along the length of the rear walls which opens into the central cavity 60. This simplifies the die used to form the component and has advantages with respect to the extrusion process regarding rate of production, cost of the die, wear of the die, and maintenance of the die.

The center cavity 60 is generally of a square cross section, however, the sidewalls have been outwardly stepped to reflect the outward steps in the shoring post 4. In this way, the node sleeve 40 is sized to slide along the exterior of the shoring post 4 and provide a close fit therewith. As generally shown in FIG. 1, each node sleeve 40 is secured to the shoring post adjacent one end of the shoring post. The spacing of the node sleeve from the end of the post is a consistent distance with respect to each upper node and with respect to each lower node, however, the distance that the lower node is spaced from the closest end of the shoring post is different than the spacing of the upper nodes from the closest end of the shoring post.

This is desired as the node sleeve is symmetrical and thus the shoring post 4 can be used in an inverted orientation. There may be certain applications where there is an interference situation using the shoring post in the normal manner and the inverted orientation of the shoring post may eliminate this interference.

The shoring post 4 has a series of holes 74 spaced along the length of the sidewall of the post on two sides thereof. These are used for securing of the node sleeves. Each node sleeve 40 has four nodes 42 corresponding to the four sides of the short post. Each node includes a vertically extending ledger support face 44 with an elongate slot 46 located behind the ledger support face. The rear wall 50 of the elongate slot 46 has a center opening 52 opening onto a wall of the shore post.

The center cavity 60 is shaped to snuggly slide along the shoring post 4. Each node sleeve 40 includes upper support shoulders 62 which form the perimeter of the node sleeve and lower support shoulders 64 which are also provided around the perimeter of the node sleeve.

The node sleeves can be connected to the short post in many ways. One particular approach for connecting of the node sleeve provides U-shaped saddle brackets 100 which are mechanically fastened by bolts 39 below and above the sleeve. (See FIGS. 7 and 8). These brackets are of a shallow depth and partially received in opening 52 to leave the elongate securing slots 46 open for receiving the tongue 29 or prong connectors of the ledger frames. As can be appreciated, the ledger frames are used to provide bracing between the shoring posts, thus the downward load on the node sleeve is not particularly high. It can also be seen that the node sleeve positions the elongate securing slots 46 outwardly of the shoring post such that the ledger frames are easily connected to any of the nodes without interference with the shoring post.

Each node of the node 42 sleeve 40 includes two vertically extending ridges 92 which provide additional stiffness and also serve to protect the node sleeve. As can be appreciated, shoring posts are subject to substantial abuse. This is a function of the shoring posts being transported to jobs, stored on site and assembled and disassembled as required. For this reason, the sleeve is of a relatively robust construction and each node is relatively stiff and includes outwardly extending members 92 from the shoring post which protect the integrity of the elongate slot 46.

It is also possible to use the extruded aluminum alloy node sleeve 40 of FIG. 6 with the shoring post 4 and weld the sleeve 40 to the shoring post. The upper and lower support shoulders 62 and 64 located at the top and bottom of the sleeve provide a good surface for welding of the sleeve to the post.

Figure 7:
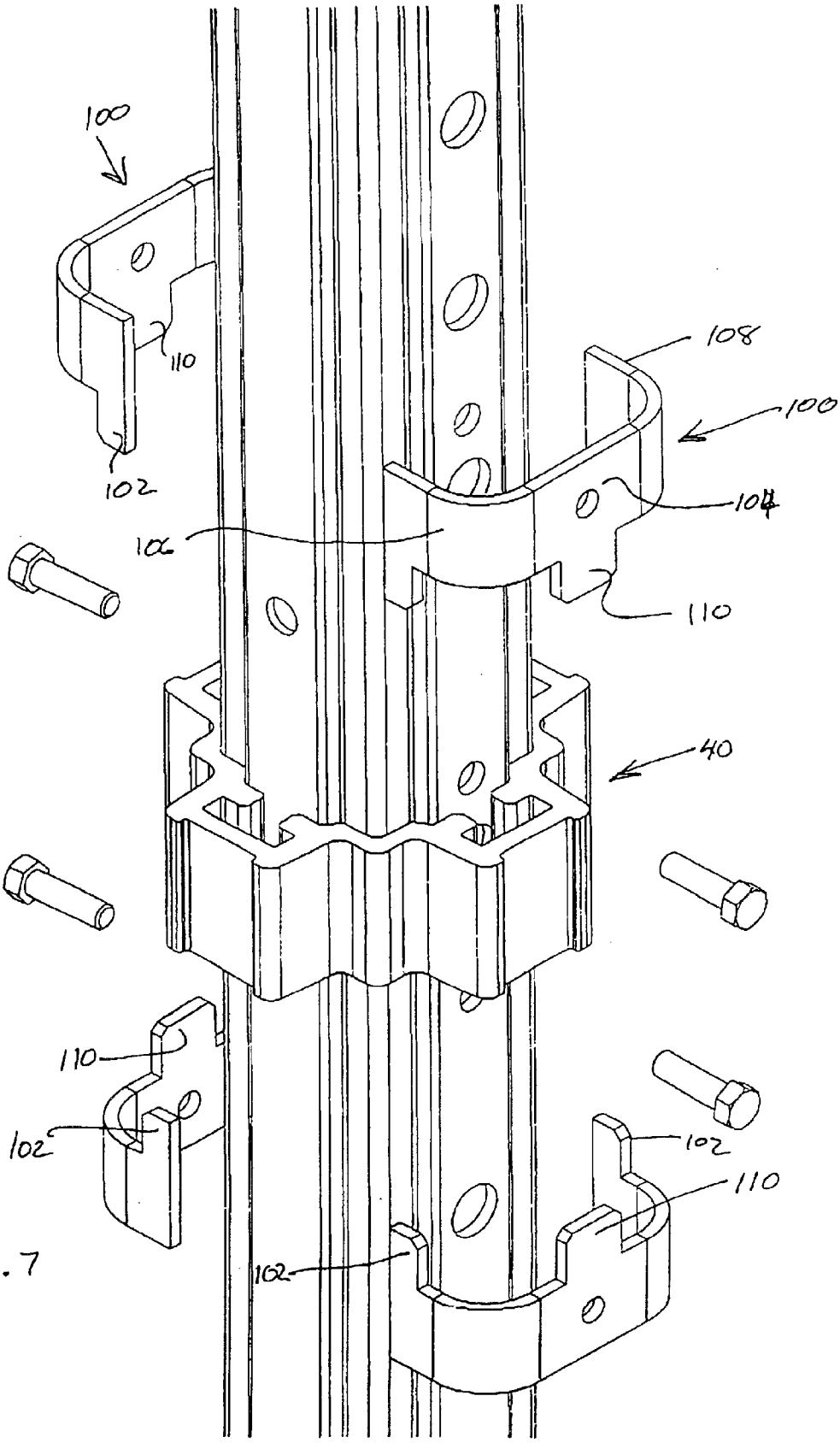
FIG. 7 is a partial perspective view of a shoring post with a node sleeve thereon about to be secured by "U" connectors.
Figure 8:
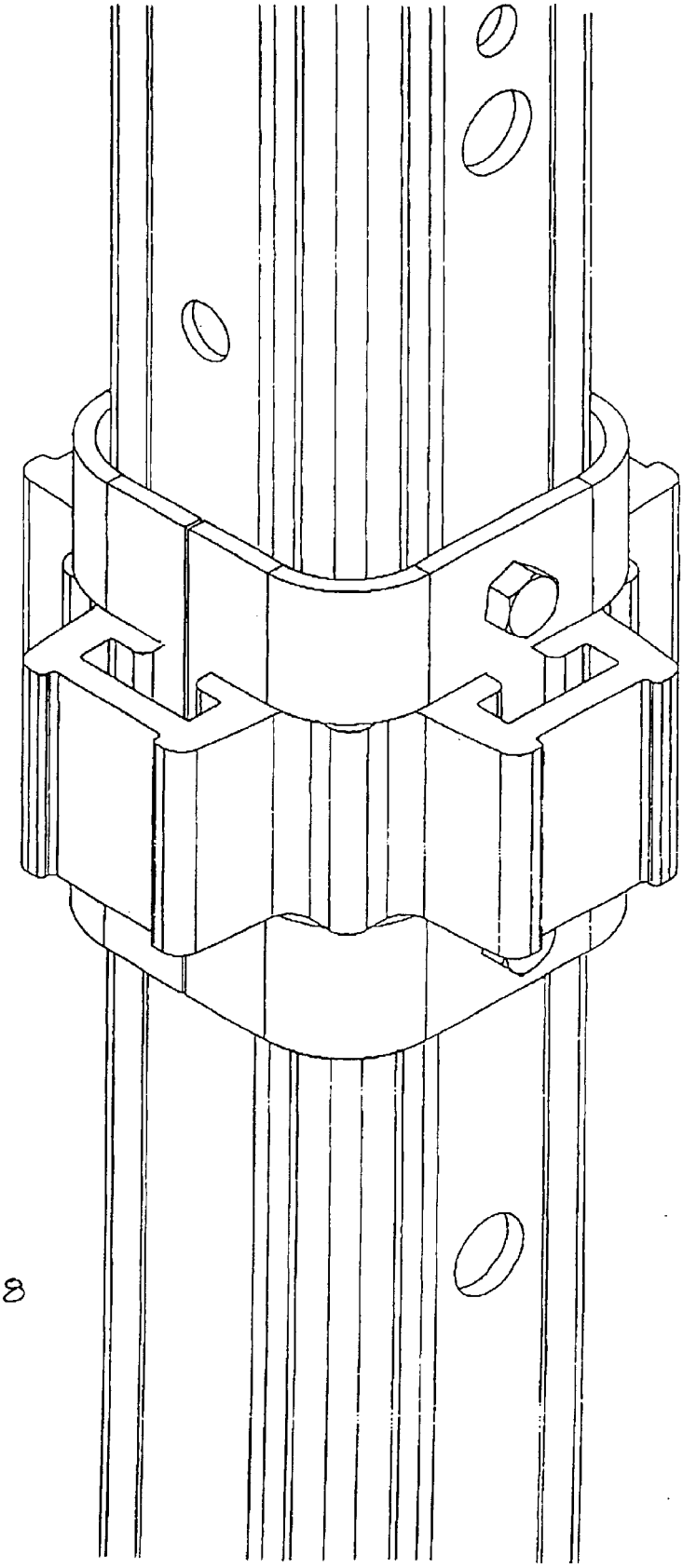
FIG. 8 is a partial perspective view of a shoring post with a mechanically secured connector sleeve.

FIGS. 7 and 8 show the preferred mechanical connection of the node sleeve 40 to the shoring post 4. The "U" shaped connector 100 has a base portion 104 with two outwardly extending arms 106 and 108 for engaging the node sleeves on three sides of the shoring post. End tabs 102 and center tabs 110 are received in openings 52 of the node sleeve 40. A single bolt preferably secures each "U" shaped connector. A lower connector can be secured to a shoring post to support a node sleeve. The upper connector can then be secured to fix the node sleeve in position.

The node sleeve of the invention is easy to locate and secure on the shoring post 4 and provides a simple durable connection point for connecting with ledger frames. If through abuse or wear, the node sleeve becomes damaged, it is possible to easily replace the node sleeve on site by release of the mechanical securement and it is convenient to locate and secure a new node sleeve. This is particularly advantageous due to the abusive environment in which shoring equipment and scaffolding equipment is used. The mechanical securement effectively allows extended use of the shoring post by providing a node which is difficult to damage and if damaged, can be easily replaced. With welded systems, it is perhaps possible to repair on site but the task is more difficult. Other systems have merely tried to provide loop attachments to one side of the shoring post for defining a connecting slot. These types of systems are more prone to damage and do not have the strong integrity of the node sleeve connector as shown, where the actual node sleeve defines the front and rear surfaces of the connecting slot. The node sleeve serves to protect the shoring post.

The mechanical securement of the node sleeves to shoring posts allows an owner of shoring equipment to adjust his equipment according to the particular market. For example, the shoring post can be converted to a shoring frame system by means of mechanical connectors as shown in our earlier U.S. Pat. No. 4,841,708. If the demand for standalone shoring post ledger systems increases relative to the demand for shoring frame systems, the contractor can convert some of the shoring frame systems into shoring posts by merely disassembling the shoring frame systems to provide two independent shoring posts and adding node sleeves to the posts. It is also possible to convert back to shoring frames systems. Although this does require some labour component, the capital cost is low and it also allows effective salvage of equipment that is already available. Furthermore, it is possible to use a combination of the two systems.

Figure 9:
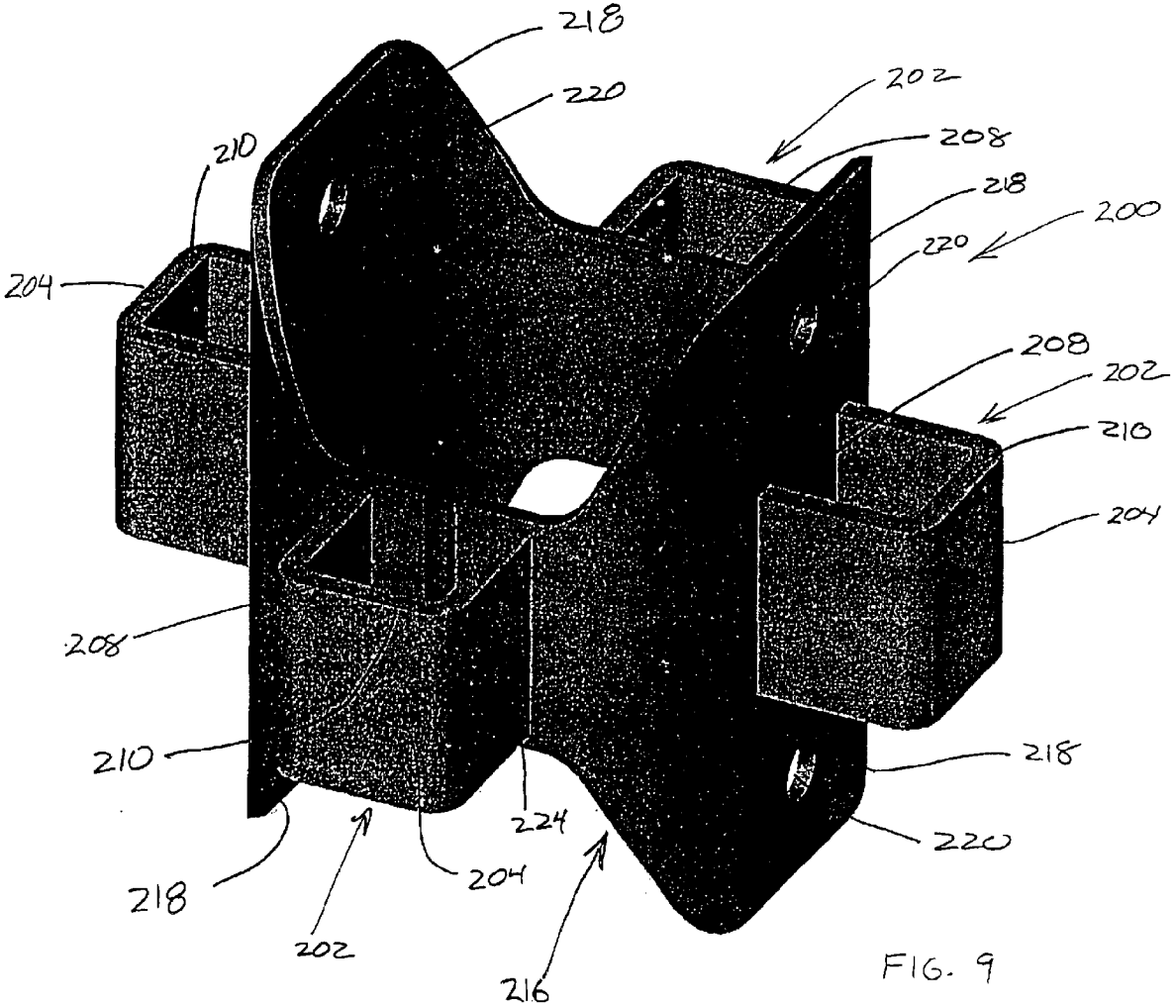
FIG. 9 is a perspective view of an alternate connecting node for use with the shoring post.
Figure 10:
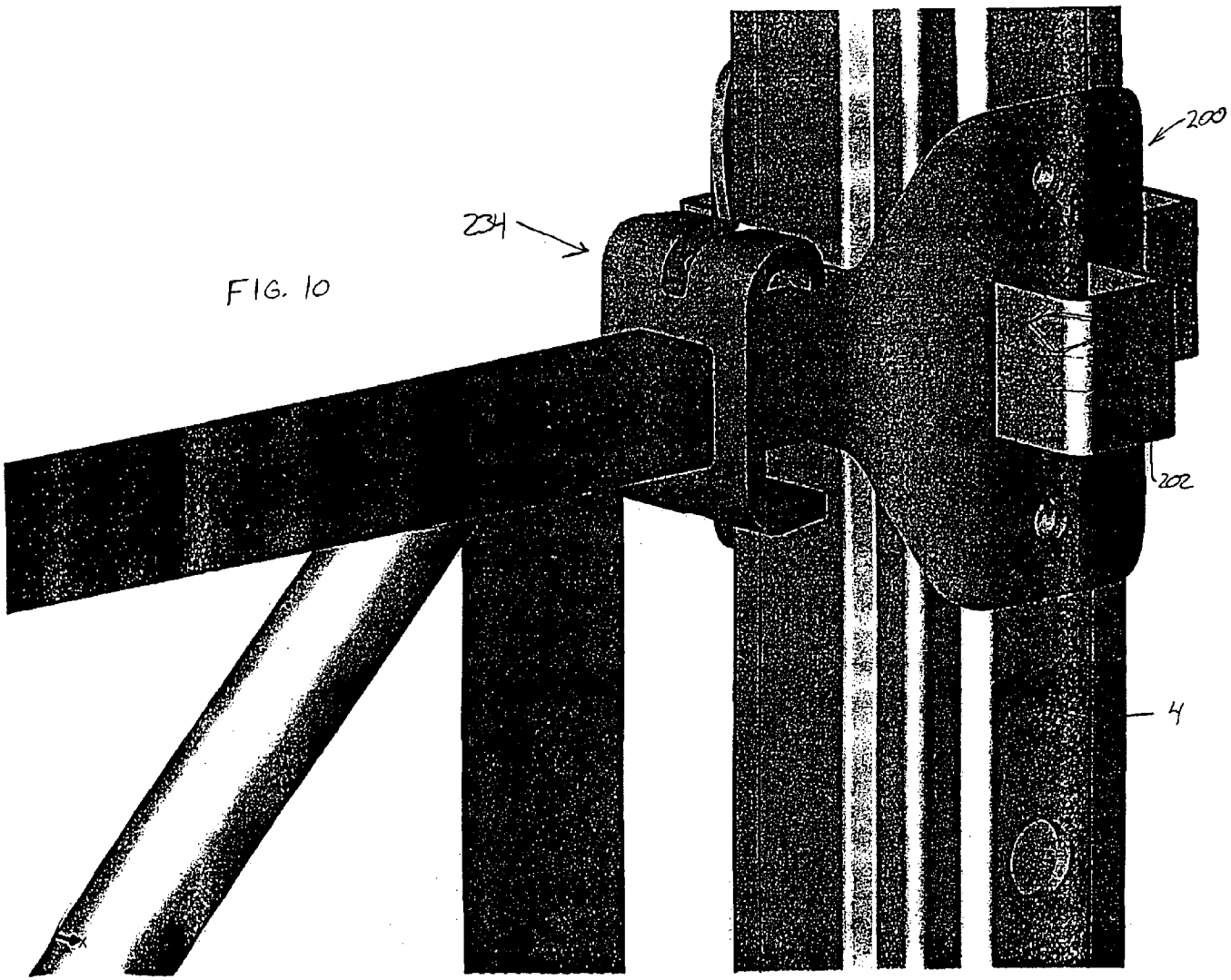
FIG. 10 is a partial perspective view of a shoring post and a portion of a ledger frame connected to the node sleeve.

The alternate node sleeve 200 shown in FIG. 9 has four nodes 202, for positioning on four sides of the shoring post. Each node includes a ledger support face 204, a securing cavity 206, upper support shoulders 210, and a rear wall 208. The nodes are supported by a sleeve 216, which is generally rectangular in cross section and has four securing tongues 218, for attaching of the sleeve to the shoring post. The preferred shoring post 4 as shown in FIG. 10 has two sides thereof with a number of ports in the side walls thereof which allow mechanical securement of the node sleeve 200, to the shoring post. With this arrangement two of the securing tongues 218, are located on one side of the sleeve 216, and the two remaining securing tongues are located directly opposite these securing tongues. Each of these securing tongues include a securing port 220, the vertical spacing between securing tongues located to one side of the sleeve is approximately four inches to provide good separation of the mechanical securement and to align with existing ports provided in the shoring post 4, as shown in FIG. 9, the alternate node sleeve is of a welded fabrication with the four nodes welded to the sleeve 216, and with the sleeve 216 having a weld seem 224.

Figure 11:
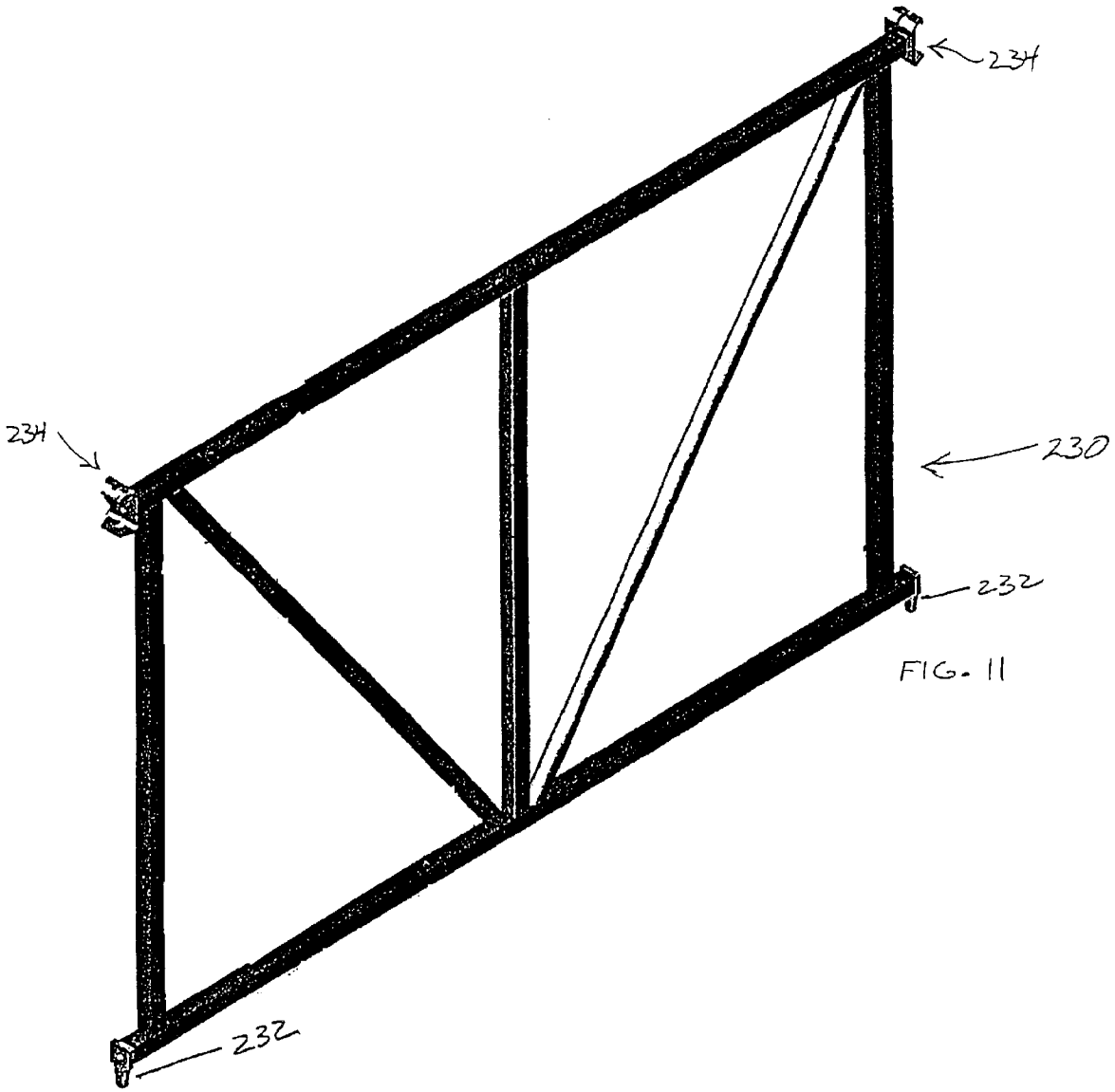
FIG. 11 is a perspective view of the ledger frame.
Figure 12:
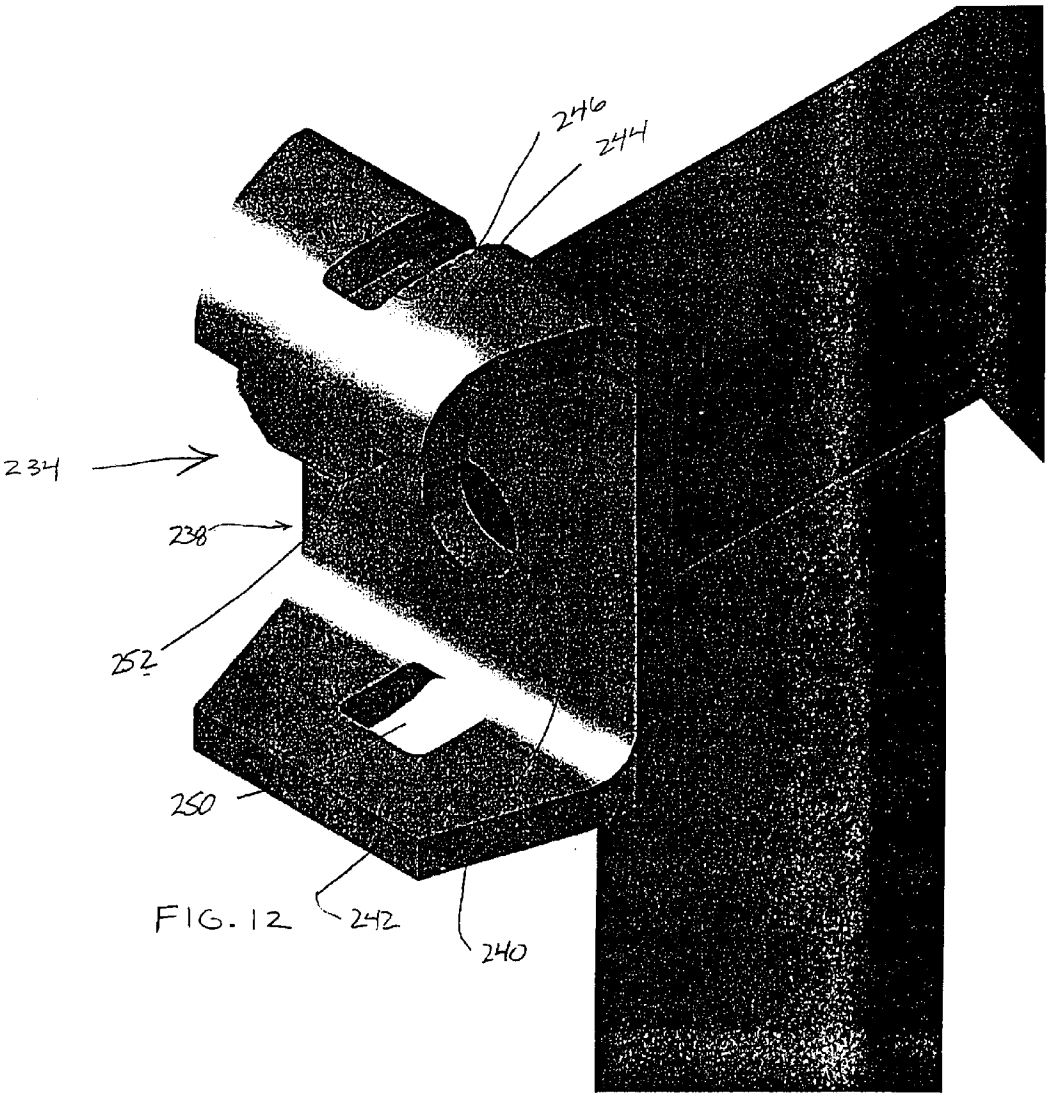
FIG. 12 is a partial perspective view of an upper and a ledger frame.
Figure 13:
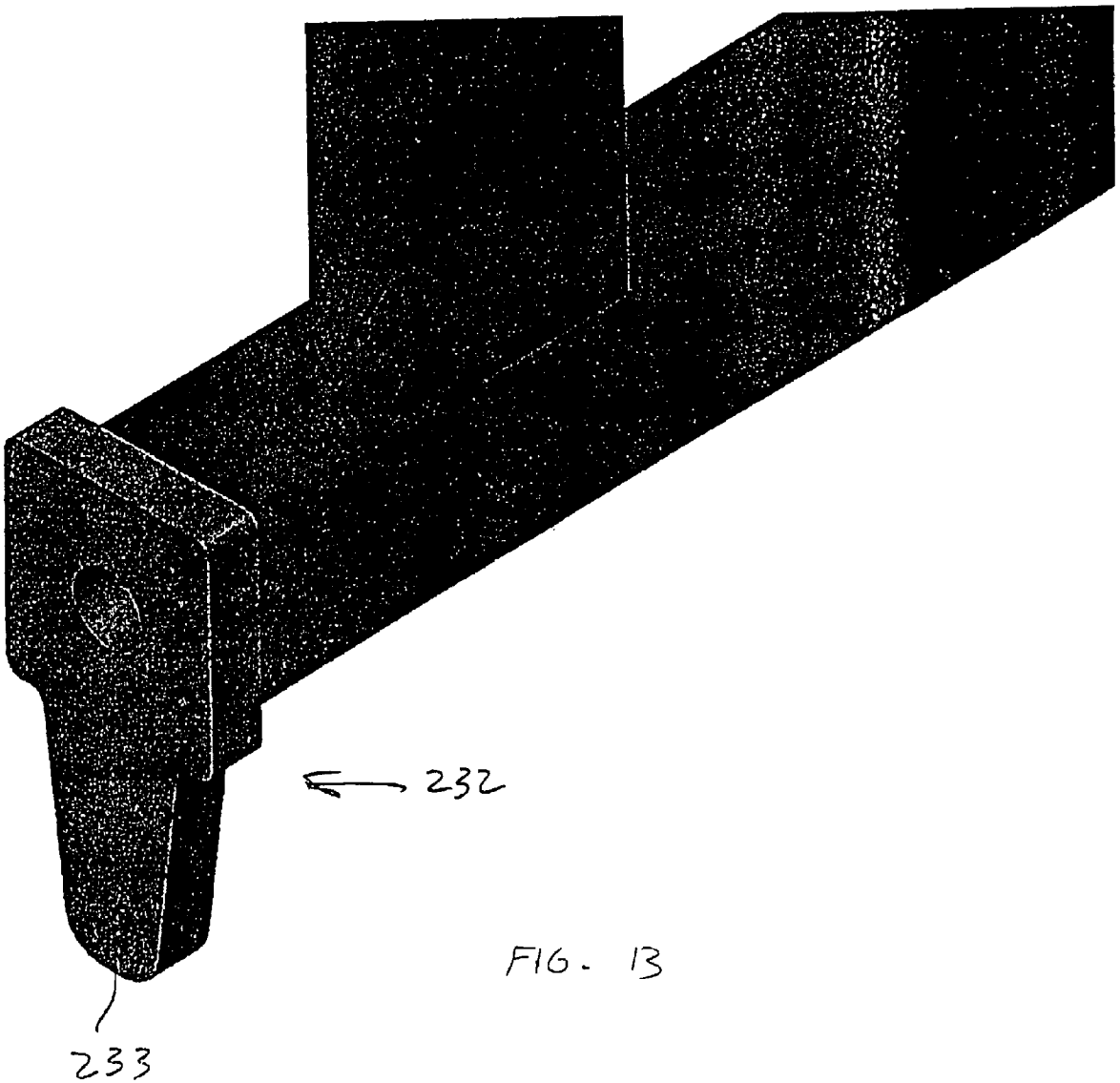
FIG. 13 is a partial perspective view of a lower end of a ledger frame with a drop in connector.

A preferred ledger frame 230 is shown in FIG. 11. This ledger frame has two lower drop in prong connectors 232 and two upper swing in connectors 234. The drop in prong connectors 232 include a tapered end 233 for facilitating ease of insertion of the prong connector in a node on the shoring post.

Figure 14:
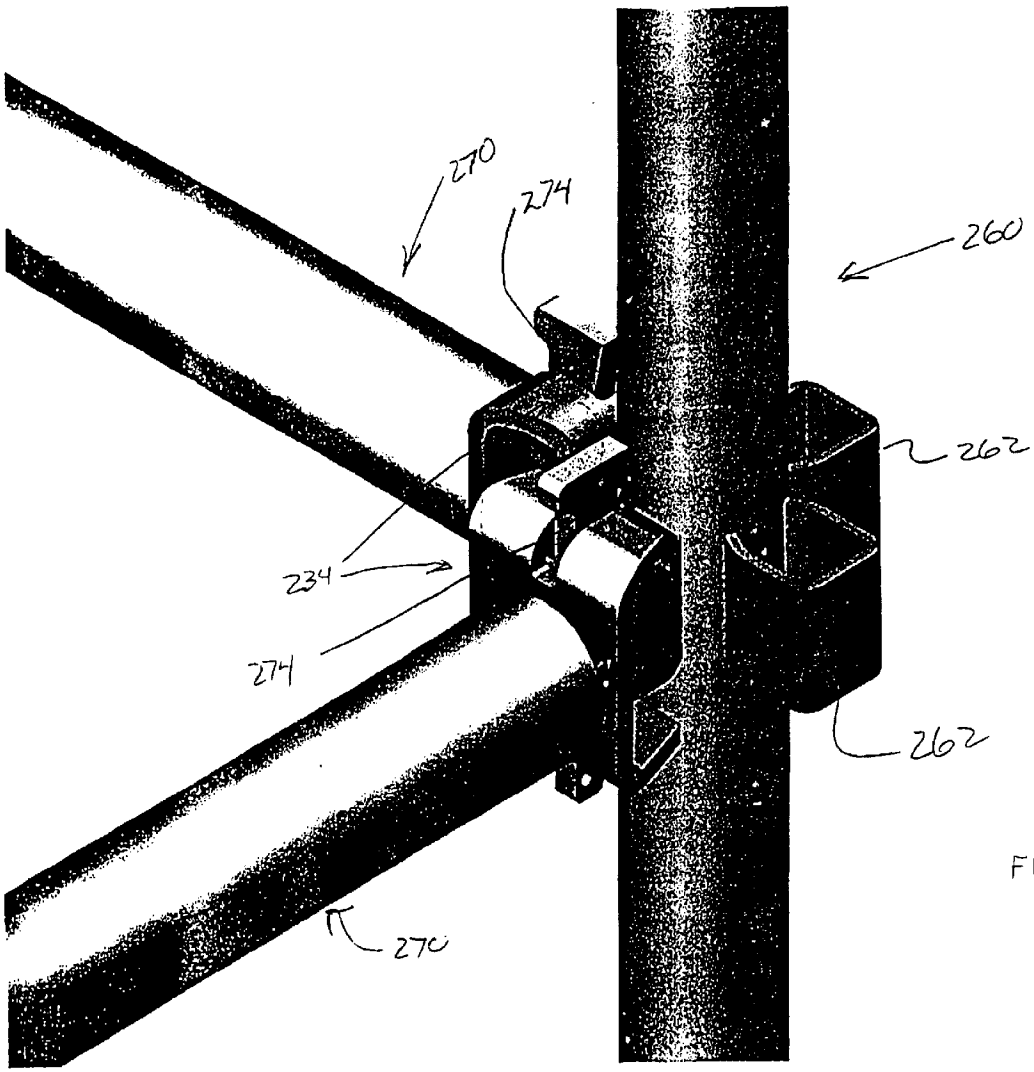
FIG. 14 is a partial perspective view of a scaffolding post with securing nodes and horizontal ledgers attached thereto.

Each swing in connector 234 includes a channel portion 238 which is open horizontally and to the exterior of the ledger frame. The channel portion 238 includes a base 240, a bottom flange 242 and an upper flange 244. The upper flange includes a wedge guide slot 246 and the bottom flange 242 includes a bottom wedge guide slot 250. The upper flange 244 includes a downwardly extending initial positioning tab 252 for receipt in the securing cavity 206 of a node 202, the ledger frame is initially positioned on a shoring post having nodes 202 by positioning of the tapered end 233 in these securing cavities 206 of the lower nodes and the upper portion of the frame is then aligned with the upper nodes such that the ledger frame can be swung inwardly to allow the positioning tab 252 to be inserted in the securing cavity 206 of an upper node. It is noted that the initial positioning tab 252 includes two cam surfaces 253 for allowing the connector to be forced upwardly and allow the positioning tab 252 to clear the upper shoulders 210 of a node and then allow the tab to drop into position. This is a loose positioning of the ledger frame on the upper nodes of two shoring posts which may not be in perfect parallel position or at the exact modular spacing. The upper connectors 234 allow the ledger frame to be swung into place and loosely position on the shoring post. After this is accomplished a captured wedge not shown in FIGS. 10 or 11 is used for securing of the ledger frame to the shoring post. An example of such captured wedges is shown in FIG. 14 where the captured wedges 274 are driven downwardly through the guide slots of the upper connector 234 to securely attach the horizontal ledgers 270 to the scaffold shoring post 260. The captured wedges 270 are of a tapered shape to initially draw the base 240 of the channel portion 238 into the ledger support face 204 of the node. The captured tapered wedge provides a strong mechanical connection of the ledger frame to the shoring post. As can be appreciated the wedges can be located by hammering as is typical with other scaffold equipment and provide a strong mechanical connection which is easily released by hammering on the projecting downward end of the wedge.

The scaffold upright 260 is of a smaller tubular design and is for use with horizontal ledgers 270 having the particular swing in connectors 234. In many applications it is desirable for the shoring system to work advantageously with a scaffolding system or with scaffolding uprights such as 260. With the present design the scaffold post 260 is provided with the same node connectors in this case node connectors 262 and will connect with any of the swing in connectors 234 or the drop in prong connectors 232. With this arrangement a scaffolding post may be positioned at one end of a shoring assembly to provide specific support which may be off modular relative to the shoring system.

The alternate node sleeve 200 is preferably of a fabricated steel assembly with four orthogonal faces for engaging the securing faces of the shoring post 4 as shown in FIG. 10. The node sleeve includes curved sections between the orthogonal faces for forming the transition. The alternate node sleeve is sized for snug receipt on the shoring post but is slide able there along. The preferred attachment is using a mechanical bolt and plate arrangement where the plate can be positioned interior to the shoring post while leaving the center of the shoring post open. It is possible that this steel fabricated node sleeve is welded to the shoring post or other attachment arrangements are possible.

Figure 15:
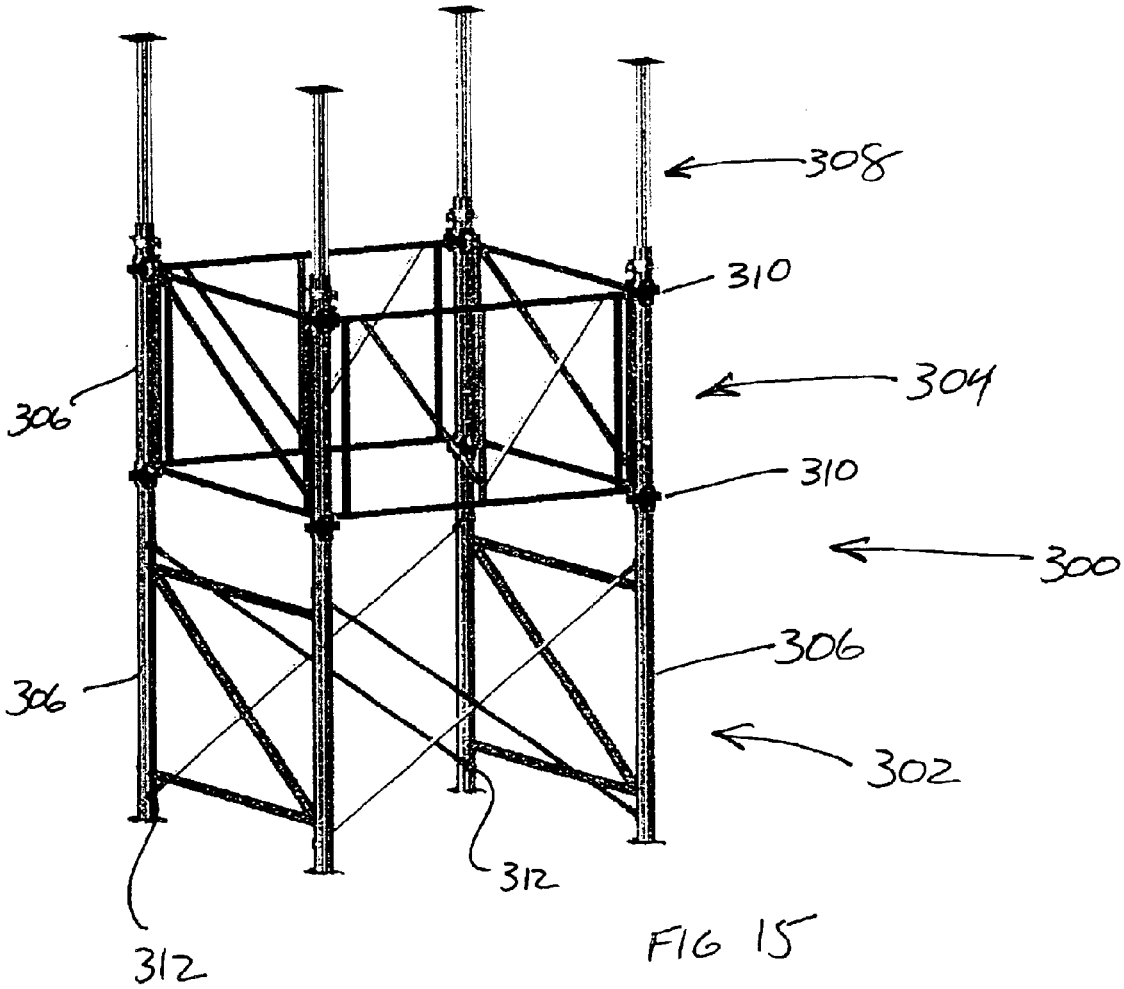
FIG. 15 is a perspective view showing a combined ledger frame and diagonally braced frame system.

The system 300 of FIG. 15 shows a combined frame system 302 and ledger frame system 304. The shoring legs 306 are of the same cross section and are thus interchangeable. Each leg is also capable of receiving any of the key accessories such as the leg extensions 308.

Figure 16:
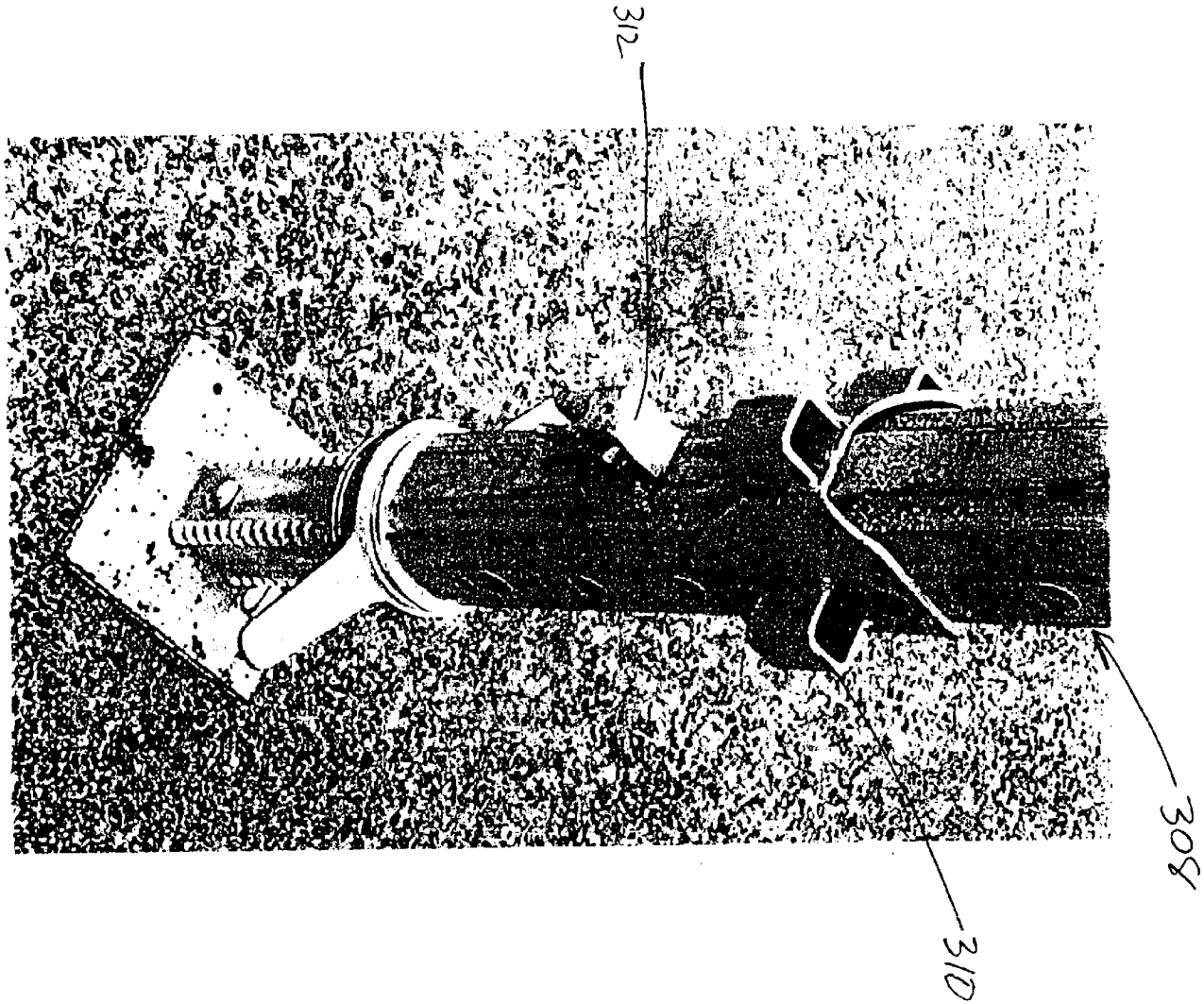
FIG. 16 is a partial perspective view of a shoring leg with node connector and diagonal brace latch.
Figure 17:
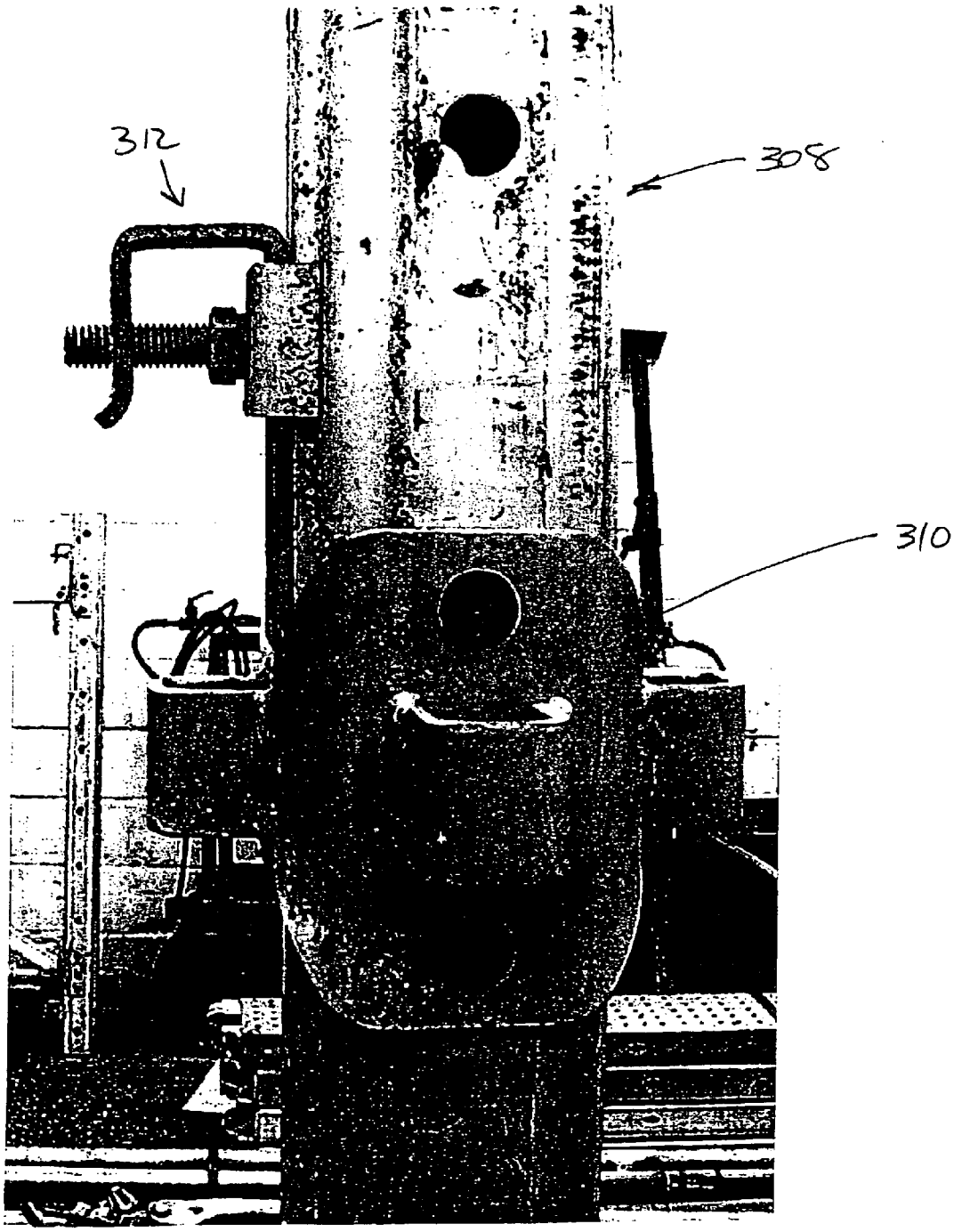
FIG. 17 is a partial perspective view of the shoring leg node connector and diagonal brace latch.

As shown in FIGS. 16 and 17, the shoring legs 308 can be provided with the node collar 310 for the ledger frames as well as the diagonal brace latch connectors 312. The connection points are different and both can be present.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A shoring post for use with a ledger frame, said shoring post comprising an extruded tubular body of a generally rectangular cross section defined by four sidewalls, each sidewall including an outwardly stepped center section running the length of said shoring post with a corresponding recessed channel behind said outwardly stepped center section and interior to said tubular body for receiving fasteners, said shoring post including two connecting node sleeves with each connecting node sleeve secured to said shoring post towards opposite ends of said shoring post and at different distances from the end closest to each node sleeve, each node sleeve including four nodes aligned with said four sidewalls and spaced outwardly from said sidewalls; each node being defined by an outer ledger frame support face parallel to said shoring post, an elongate connecting slot located behind said ledger frame support face and extending through said node sleeve to be open at a top and bottom surface of said node sleeve.

2. A shoring post as claimed in claim 1 wherein each node sleeve is of an aluminum alloy.

3. A shoring post as claimed in claim 1 wherein each node sleeve is an aluminum alloy extrusion.

4. A shoring post as claimed in claim 1 wherein each node sleeve is secured to said shoring post using a mechanical fastening arrangement.

5. A shoring post as claimed in claim 1 wherein each node sleeve is secured to said shoring post by a weld connection.

6. A shoring post as claimed in claim 1 wherein each elongate connecting slot is open to a sidewall of said shoring post.

7. A shoring post as claimed in claim 1 wherein each elongate connecting slot is open to a sidewall of said shoring post and includes a stepped wall profile at said opening and at a rear surface partially defining said elongate connecting slot.

8. A shoring post as claimed in claim 7 including two cooperating mechanical plate fasteners securing each node sleeve to said shoring post, said cooperating plate fasteners being located on opposite sides of said shoring post and each mechanical plate fastener including support shoulders in contact with said load transfer surfaces of the respective node sleeve to maintain the position of said node sleeve, each plate fastener including a mechanical securement thereof to said shoring post beyond said node sleeve.

9. A shoring post as claimed in claim 8 wherein said shoring post has a series of holes spaced in the length of said shoring post on each of two of the sidewalls thereof which are in opposed relationship, and said cooperating plate fasteners use said series of holes for connection with said shoring post.

* * * * *